United States Patent [19]

Rice

[11] Patent Number: 4,743,834

[45] Date of Patent: May 10, 1988

[54] CIRCUIT FOR CONTROLLING AND REGULATING POWER INPUT TO A LOAD FROM AN AC VOLTAGE SUPPLY

[75] Inventor: Richard M. Rice, Augusta County, Va.

[73] Assignee: Reynolds Metals Company, Richmond, Va.

[21] Appl. No.: 64,973

[22] Filed: Jun. 18, 1987

[51] Int. Cl.[4] ..... G05F 1/40

[52] U.S. Cl. ..... 323/239; 323/242

[58] Field of Search ..... 323/237, 239, 242, 243

[56] References Cited

U.S. PATENT DOCUMENTS

| | | | |
|---|---|---|---|
| 3,207,975 | 9/1965 | Pintell | 323/239 X |
| 3,241,044 | 3/1966 | Mills | 323/22 |
| 3,394,244 | 7/1968 | Smith, Jr. | 219/243 |
| 3,480,537 | 11/1969 | Garnett | 323/237 X |
| 3,571,696 | 3/1971 | Liska et al. | 323/242 X |
| 3,663,943 | 5/1972 | Nakajima et al. | 321/18 |
| 3,699,305 | 10/1972 | Reenstra et al. | 219/200 |
| 3,728,610 | 4/1973 | Switsen | 321/47 |
| 3,896,369 | 7/1975 | Nakata | 323/242 X |
| 3,939,394 | 2/1976 | Suzuki | 321/18 |
| 4,061,961 | 12/1977 | Baker | 323/239 |
| 4,350,949 | 9/1982 | Fujita | 323/237 X |
| 4,463,269 | 7/1984 | Yashima | 323/242 X |
| 4,654,579 | 3/1987 | Masaki | 323/242 X |
| 4,668,908 | 5/1987 | Aoki et al. | 323/239 X |

*Primary Examiner*—Patrick R. Salce
*Assistant Examiner*—Marc S. Hoff
*Attorney, Agent, or Firm*—Alan T. McDonald

[57] ABSTRACT

A circuit for controlling power to a load from an AC voltage supply is disclosed. The circuit permits power input to begin at any point either the positive, negative or both halfwaves of an AC waveform and compensates for variations in the AC voltage supply to provide the same power level to the load.

15 Claims, 4 Drawing Sheets

CIRCUIT FOR CONTROLLING AND REGULATING POWER INPUT TO A LOAD FROM AN AC VOLTAGE SUPPLY

BACKGROUND OF THE INVENTION

It is a common practice in many areas to control AC electrical input power to a load by reducing line supply voltage. Most commonly, this has been accomplished by means of a step-down transformer.

Such transformers, while effective, cause numerous problems in some circuits. Their major disadvantages lie in their size, i.e., they are greatly larger than any other circuit component, and in their inability to regulate power in the face of varying supply voltage.

With the advent of solid state devices the step-down transformer has been largely replaced with such devices as thyristors. These devices regulate power input not by voltage change, as with the step-down transformer, but rather by limiting the application of voltage to a part of the AC waveform.

While thyristors are effective for this purpose, they also have characteristics which do not always make them acceptable as power regulators. First, these devices, simply with a resistive gate circuit, can regulate power only in the rising quarter of the AC waveform, since the thyristors permit current to flow therethrough once a firing current is reached, which current must eventually be reached within the first quarter of the AC waveform. In addition, these devices have no ability to compensate for supply voltage fluctuations. As such, these devices have a tendency to fire early with increased supply voltage, resulting in oversupply of power to the load, and to fire late with reduced supply voltage, resulting in insufficient power to the loads.

It is known to allow for second quarter of the AC waveform firing of the thyristor in a circuit by means of a ramp circuit, in which a charging current controlling resistor limits current to a firing capacitor. The capacitor is then charged and, when sufficiently charged, discharges through a breakover voltage device, such as a diac, to fire the thyristor. By choosing the proper resistance and capacitance, firing of the thyristor can be selected to occur at any point along the positive, or negative halfwave, with rectification, of the AC waveform. However, after the firing point has been set, variations in supply voltage will still cause over and under power to the load based upon fluctuations of the supply voltage, as there is no means for controlling the voltage applied to the breakover device.

It is also known to stabilize the voltage applied to the ramp circuit, and thus stabilize the slope of the ramp supplied to the breakover device, by means of a zener diode bleed off circuit. In this circuit, excess current bypasses the ramp circuit through the parallel zener diode. Such a circuit guarantees that firing of the thyristor will occur at the same point of the positive or negative halfwave of the AC waveform, without regard to the amplitude of the supply voltage or fluctuations thereto.

There remains, however, the problem of controlling the power supply to the load with voltage fluctuations. None of the known circuits can compensate for supply voltage change and provide the same level of power to the load. It is desirable, therefore, to provide a circuit which, while maintaining stabilization of the firing of the thyristor, can also advance or delay firing to compensate for variations in supply voltage and thereby provide an unchanged level of power to the load.

THE PRESENT INVENTION

According to the present invention, this desirable control is provided. The circuit of the present invention employs a bleed off transistor to regulate charging current supplied to the firing capacitor. This control forces the capacitor to charge at a rate such that it fires at a different point along the positive or negative halfwave of the AC waveform for different supply voltages, resulting in the preselected power input level being supplied to the load.

BRIEF DESCRIPTION OF THE DRAWINGS

The improved power control circuit of the present invention will be more fully described with reference to the drawings in which.

DETAILED DESCRIPTION OF THE PREFERRED EMBODIMENTS

Figure 1:
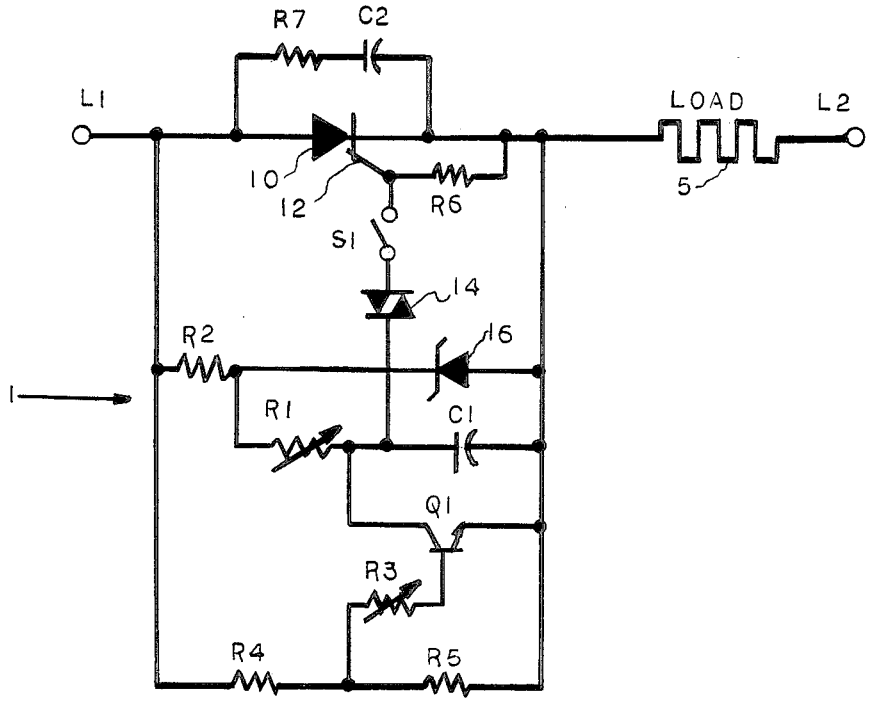
FIG.1 is a schematic of a power control circuit according to the invention.

Turning now to FIG. 1, a power control circuit according to the present invention is illustrated. A supply voltage is applied to terminals L1 and L2. A load 5, for example a heater wire, or other resistive or inductive element, is connected between terminals L1 and L2 and in series with a control circuit 1. The control circuit 1 comprises a thyristor 10, which, for example, may be a silicon control rectifier (SCR) or other one-way electronic switch, is connected in series with the load 5. As is well known to those skilled in the art, thyristor 10 will permit current to begin to flow from terminal L1 to terminal L2 only when a firing current is applied to its gate through line 12 and will continue to allow current to flow until the AC supply voltage reaches its zero crossing point. It is, therefore, the firing pulse current supplied to line 12 that is controlled by circuit 1.

The firing pulse current for thyristor 10 is reached when sharp triggering device 14 reaches it preselected breakover voltage. Device 14 may be, for example, a diac. Thus, it is also the voltage supplied to sharp triggering device 14 that is controlled by the circuit 1 to provide power control through thyristor 10 to load 5.

Voltage control to sharp triggering device 14 is accomplished as follows. Charging current to capacitor C1 flows through resistor R1. Resistor R1 is preferably a variable resistor and is tuned or set to achieve the firing point along the positive halfwave of the AC waveform. Increasing the resistance of R1 delays the firing point of thyristor 10 and decreasing the resistance of R1 advances the firing point of thyristor 10. The voltage between R1 and C1 ramps up until it achieves the breakover voltage of the sharp triggering device 14.

A zener diode 16 is connected in parallel with capacitor C1 and resistor R1 and in series with a resistor R2. Zener diode 16 provides a constant voltage across resistor R1 and capacitor C1, which stabilizes the charging current through R1 to C1, thus isolating the charging current for capacitor C1 from variations in the supply voltage. Resistor R2 limits current through zener diode 16, protecting zener diode 16 from burnout. As will be pointed out below, zener diode 16 and resistor R2 are not essential to the control circuit 1, since their functions may also be provided by transistor Q1, but may be present in circuit 1 to lower the effect of higher supply voltages on capacitor C1.

Connected in parallel to capacitor C1 is a compensating transistor Q1. Transistor Q1 has its base connected to the supply voltage through at least one resistor R3, which is preferable a variable resistor. Preferably, the supply voltage is divided by a pair of resistors R4 and R5, such that the majority of the supply voltage is dissipated across R4. The presence of resistors R4 and R5 permit fine tuning of circuit 1 and stabilizes the base current to Q1 with changes in, for example, circuit components or component temperature effects and the like, thereby stabilizing the bleed current through transistor Q1.

This bleed current through transistor Q1 is the compensation control that effects the ramp-up voltage between resistor R1 and capacitor C1 with fluctuations of the supply voltage. Thus, compensating transistor Q1 lowers the slope of the ramp as the supply voltage increases and raises the slope of the ramp as the supply voltage decreases, such that the breakover voltage of the sharp triggering device 14 occurs earlier as the supply voltage falls and later as the supply voltage rises. The net result is a delivered power input to load 5 that does not vary with changes in the supply voltage. Transistor Q1 may also assume the role of zener diode 16 to isolate the charging current for capacitor C1 from variations in supply voltage, thus making zener diode 16 unnecessary. However, where relatively high supply voltage is being employed, the zener diode 16 is more effective for this purpose, and thus the combination of these elements in parallel is preferred, at least in such cases.

A resistor R6 is preferably connected between the gate and the cathode at thyristor 10. Resistor R6 provides a bleed off path for any internal current leakage which may occur within thyristor 10, so that internal current leakage does not achieve a level sufficient to trigger thyristor 10 prematurely and provide excess power to load 5.

A snubber circuit comprising resistor R7 and capacitor C2 in series is preferably connected in parallel to thyristor 10. This snubber circuit compensates for high transient voltage changes in the supply voltage. Such high transient voltages can cause the internal capacitance of thyristor 10 to conduct sufficient internal current to prematurely fire the thyristor, again supplying excessive power to load 5. The snubber circuit smooths transients sufficiently to prevent sufficiently high internal capacitor current within thyristor 10 to cause it to fire by providing a bypass for these momentary currents.

If it is desired to externally control circuit 1, such that load 5 receives power only when desired, a switch S1 may be placed in series with sharp triggering device 14, which, when turned off, will prohibit thyristor 10 from receiving a firing pulse. Such a switch S1 may be employed, for example, when a manual device employing circuit 1 requires that load 5 not receive power input except when an operator is actively operating the equipment including circuit 1.

As previously mentioned, the FIG. 1 circuit allows power input to the load 5 at a selected point along the positive halfwave of the AC waveform. It is often desired to provide power input to the load 5 during both the positive and negative halfwaves of the AC waveform. The circuits in FIGS. 2, 3, and 4 accomplish this result.

Figure 2:
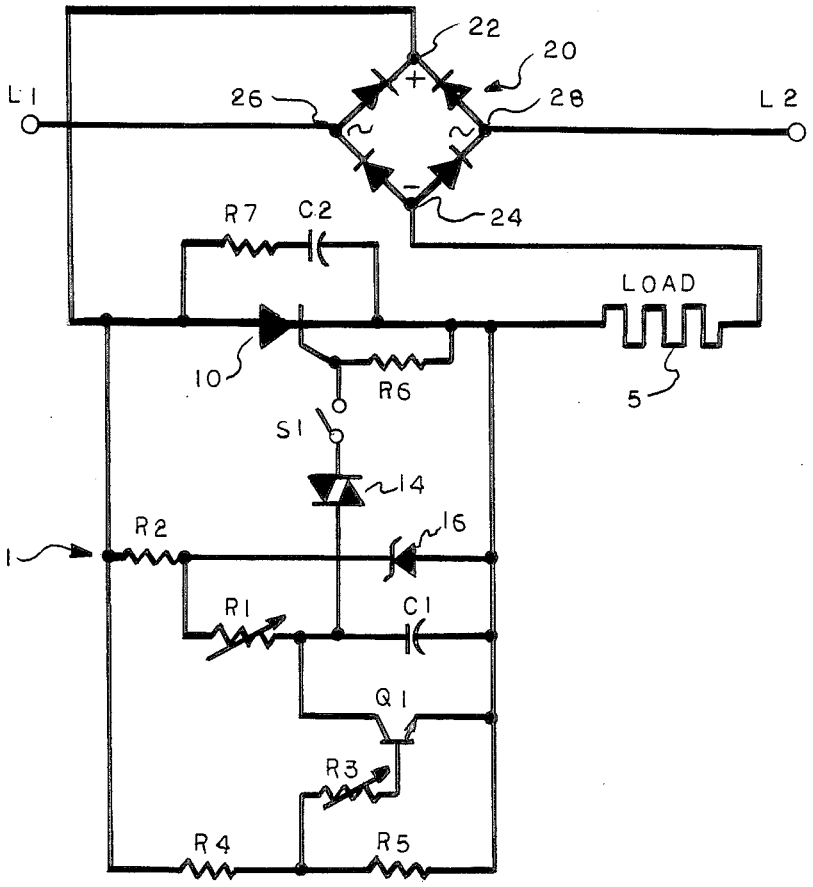
FIG.2 is a schematic of a power circuit according to the present invention including full wave rectification.

In FIG. 2, the load 5 and thyristor 10 are again connected in series between terminals L1 and L2. A fullwave bridge rectifier circuit 20 is also connected in series between terminals L1 and L2, with thyristor 10 and load 5 being connected between the positive terminal 22 and the negative terminal 24 of the fullwave bridge rectifier circuit 20, and with the AC terminals 26 and 28 of the fullwave rectifier circuit 20 being connected between terminals L1 and L2.

The fullwave rectifier bridge circuit 20 inverts the polarity of the negative halfwave of the AC waveform supplied to thyristor 10 and load 5. Thus, firing of thyristor 10 will occur at the same point of the negative halfwave of the AC waveform as it occurs in the positive halfwave of the AC waveform.

Fullwave rectifier bridge circuit 20 comprises four diodes arranged such that current may flow both to and from the AC terminals 26 and 28, but such that current may only flow to negative terminal 24 and from positive terminal 22, as is well known to those skilled in the art.

The control circuit 1 is connected across thyristor 10 in the same manner as described above in FIG. 1 and its operation need not be discussed again. Of course, the control circuit 1, now seeing positive voltage in each halfwave of the AC waveform, effectively doubles the power supplied to load 5 for a given firing point. This allows smoother delivery of power to load 5, i.e., 120 power bursts per second instead of 60 for a 60 Hertz AC power supply, and often permits firing of thyristor 10 later in the halfwave.

Figure 3:
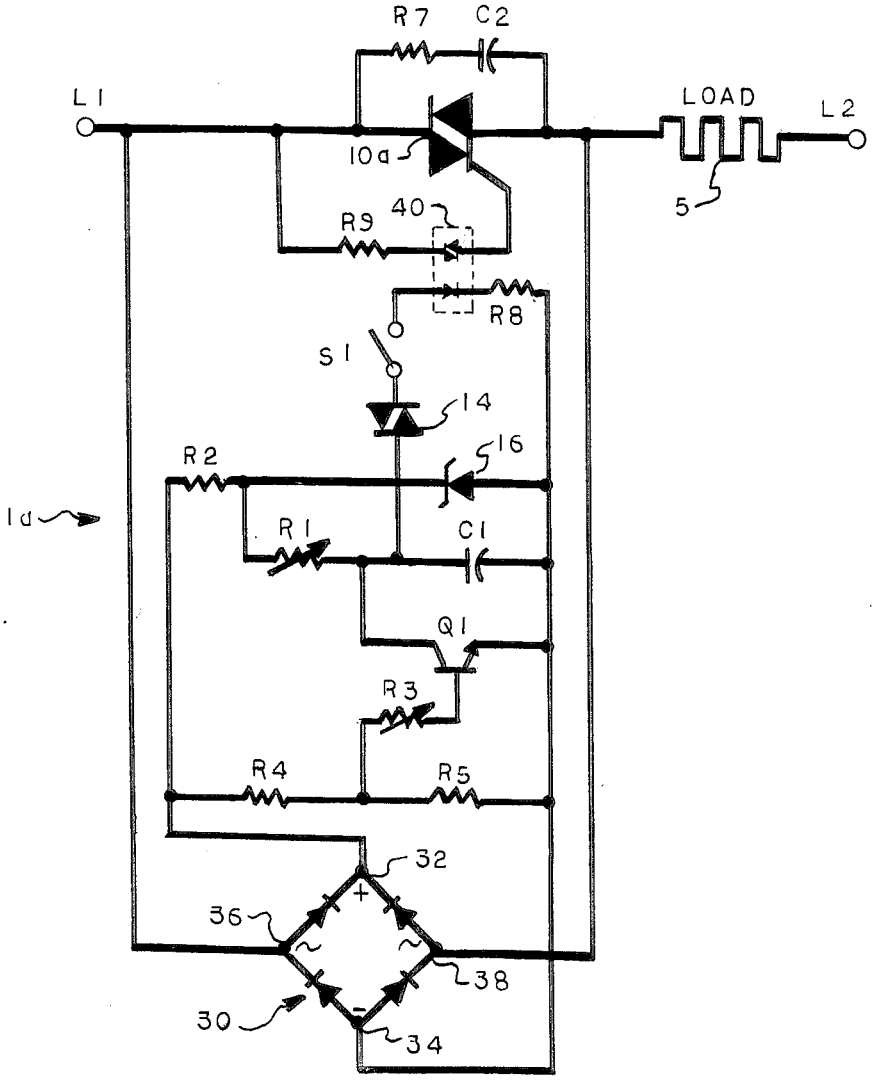
FIG. 3 is a schematic of a power circuit according to the present invention including full wave regulation by conrolling a triac.

In FIG. 3, a fullwave rectifier bridge circuit is again employed. In this Figure, however, bridge circuit 30 is positioned to rectify the control circuit 1*a* rather than the AC current supplied between terminals L1 and L2. The control bridge circuit 30 has its positive terminal 32 and negative terminal 34 connected in parallel with zener diode 16, capacitor C1 and transistor Q1 through the various resistors R1, R2, R3, R4 and R5. The AC terminals 36 and 38 of control bridge circuit 30 are connected across terminals L1 and L2 and in parallel to thyristor 10*a*. Control bridge circuit 30 fullwave rectifies the voltage across thyristor 10*a* such that the control circuit 1*a* sees a pair of positive halfwaves for each fullwave of the AC waveform and fires thyristor 10*a* at the same point of the halfwave in both the positive and negative halfwaves of the AC waveform.

Unlike the FIG. 2 embodiment, however, thyristor 10*a* and load 5 receive both positive and negative voltages. To permit this result, thyristor 10*a*, rather than being the one-way device as in FIGS. 1 and 2, is a two-way thyristor, such as a triac. Triac 10*a* has terminals 1 and 2, as well as a gate terminal, as is known to those skilled in the art. The gate terminal is connected through resistor R9 to terminal 2 of triac 10*a*.

FIG. 3 also illustrates an additional optional element. Rather than having the gate of thyristor 10*a* directly connected to control voltages of the control circuit through the sharp triggering device 14, such as a diac, as in FIGS. 1 and 2, in FIG. 3, the gate of thyristor 10*a* is connected to an optical coupler 40. The optical coupler 40 has an internal LED and photosensitive switch.

When sharp triggering device 14 exceeds its breakover voltage, current flows through the LED, causing it to glow, which in turns causes the photosensitive switch to close, allowing current to flow at the gate of thyristor 10*a*. Since thyristor 10*a* is a triac, current into or out of its gate will cause it to fire.

As the gate of thyristor 10*a* is now connected to terminal L1 to receive its firing pulse, the current limiting resistor R9 is provided to protect thyristor 10*a* from excessive gate currents. Also, a similar resistor R8 protects the optical coupler 40 from damaging current.

Figure 4:
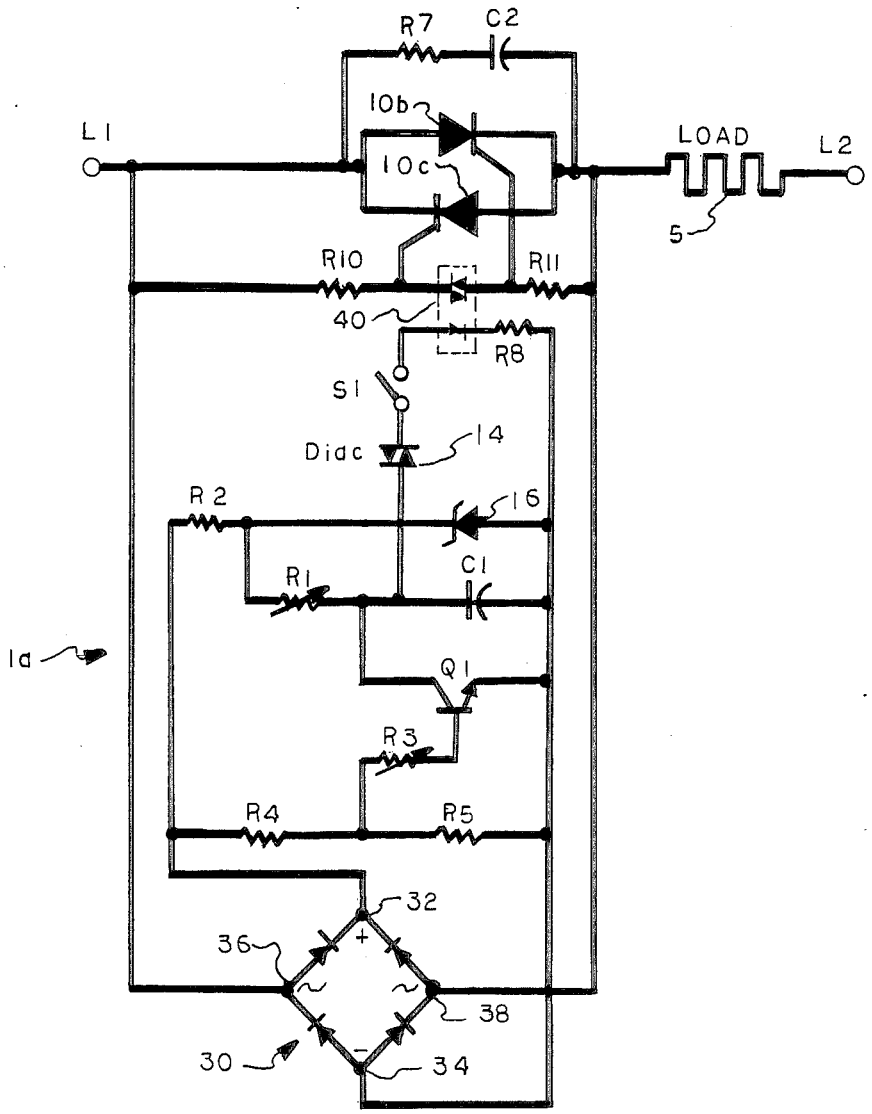
FIG. 4 is a schematic of a power circuit according to the present invention including fullwave regulation by controlling a pair of inverse-parallel silicon controlled rectifiers.

In FIG. 4, the replacement of triac 10*a* with a pair of inverse-parallel unidirectional thyristors 10*b* and 10*c*, such as a pair of SCRs is illustrated. The gates of thyristors 10*b* and 10*c* are connected on opposite sides of the optical coupler 40 so that one of them is not prematurely triggered by voltage differentials in the circuit. Resistors R10 and R11 act as bleed off resistors, similar in function to resistor R6 in FIG. 1. They also provide trigger current protection for the thyristors 10*a* and 10*c*, similar to resistor R9 in FIG. 3.

EXAMPLE

A circuit as illustrated in FIG. 1 was produced. The voltage across terminals L1 and L2 was 120 volts AC peak through a variable autotransformer. Thyristor 10 was an RCA model SK6652- SCR. Zener diode 16 was a 15-volt American Power Devices model IN4744. The sharp triggering device was a General Electric model ST-4 asymmetrical AC trigger integrated circuit with a breakover voltage of 7 volts. Transistor Q1 was a Motorola model MPS-A42 signal transistor. Capacitor C1 was a 0.224 microfarad capacitor. Resistor R1 was a 20K ohm peak value variable resistor. Resistor R2 was a 39K ohm resistor. Resistor R3 was a 15M ohm resistor. Resistor R4 was a 200K ohm peak value variable resistor. Resistor R5 was a 39K ohm resistor. Resistor R6 was a 100 ohm resistor. The load was a 28-inch long 22 gauge Nichrome heater wire.

The voltage from the transformer was varied between 100 and 120 volts. The control circuit was tuned through resistors R1 and R4 to provide the equivalent power to the Nichrome wire of a fullwave 24-volt AC supply. The circuit successfully provided the desired power supply by firing thyristor 10 at differing points along the positive halfwaves of the varied AC voltage waveforms to produce the desired power supply irrespective of the supply voltage, thus confirming the effectiveness of the control circuit of the present invention.

From the above, it is clear that the present invention provides a simple yet effective means for controlling power supplied to a load from an AC voltage source which allows for power supply to begin at any point along the positive or both halfwaves of the AC waveform and compensates for variations in the voltage supply.

While the circuit of the present invention has been described with reference to certain specific embodiments thereof, it is not intended to be so limited thereby, except as set forth in the accompanying claims.

I claim:

1. A circuit for controlling power input to a load from an AC voltage supply comprising a thyristor having its anode and its cathode connected in series with said load and said voltage supply, a capacitor and at least a first resistor connected in parallel with the anode and the cathode of said thyristor, said capacitor being connected to the cathode side of said thyistor, with the electrical node between said capacitor and said at least one resistor being connected through a sharp triggering device to the gate of said thyristor, and a transistor having its emitter and collector connected in parallel to said capacitor, said transistor having its base connected to the anode side of said thyristor through at least a second resistor.

2. The circuit of claim 1 wherein said thyristor is an SCR.

3. The circuit of claim 1 wherein said sharp triggering device is a diac.

4. The circuit of claim 1 wherein said sharp triggering device is an asymmetrical AC trigger integrated circuit.

5. The circuit of claim 1 wherein said at least a first resistor is a variable resistor.

6. The circuit of claim 1 wherein said at least a second resistor is a variable resistor.

7. The circuit of claim 1 wherein said at least a first resistor comprises a variable resistor and a fixed resistance resistor connected in series and wherein a zener diode is connected to the node between said variable resistor and said fixed resistance resistor and to the cathode side of said thyristor.

8. The circuit of claim 1 wherein said at least second resistor comprises a pair of resistors connected in series with one another and in parallel with said thyristor and a resistor connected to the node between said pair of resistors and to the base of said transistor.

9. The circuit of claim 8 wherein said resistor connected between said pair of resistors is a variable resistor.

10. The circuit of claim 1 wherein a resistor is connected between the gate of said thyristor and the cathode side of said thyristor.

11. The circuit of claim 1 further comprising an additional resistor and an additional capacitor connected in series to one another and in parallel to said thyristor.

12. The circuit of claim 1 wherein a fullwave bridge rectifier is connected in series with said load and said thyristor, with the AC terminals of said fullwave bridge rectifier being connected to said AC voltage supply, the negative terminal of said fullwave bridge rectifier being connected to said load and the positive terminal of said fullwave bridge rectifier being connected to the anode side of said thyristor.

13. The circuit of claim 1 wherein a fullwave bridge rectifier has its AC terminals connected in parallel to said thyristor, its positive terminal connected to said at least a first resistor and its negative terminal connected to said capacitor, but not to the node between said capacitor and said at least a first resistor.

14. The circuit of claim 13 wherein said thyristor is a triac and wherein the connection between the gate of said triac and said sharp triggering device is accomplished by an optical coupler, with the input side of said optical coupler being connected in series with said sharp triggering device and with a first current limiting resistor and with the output side of said optical coupler being connected in series with said gate of said triac, a second current limiting resistor and the terminal of said triac connected to said AC voltage supply.

15. The circuit of claim 13 wherein said thyristor is a pair of inverse-parallel SCRs and wherein the connection between the gates of said SCRs and said sharp triggering device is accomplished through an optical coupler, with the input side of the said optical coupler being connected in series with said sharp triggering device and with a first current limiting resistor and with the output side of said optical coupler being connected between the gates of the SCRs, with a second current limiting resistor being connected between the gate of one of said SCRs and its cathode and a third current limiting resistor being connected between gate of the other SCR and its cathode.

* * * * *